US006026523A

United States Patent [19]

Simon et al.

[11] Patent Number: 6,026,523

[45] Date of Patent: Feb. 22, 2000

[54] STORABLE PATIENT LIFT AND TRANSFER APPARATUS

[76] Inventors: William H. Simon, 1313 Partridge La., Villanova, Pa. 19085; Richard H. Tuft, 33 Waterford Way, Wallingford, Pa. 19086

[21] Appl. No.: 09/172,283

[22] Filed: Oct. 14, 1998

[51] Int. Cl.[7] ..... A61G 7/10

[52] U.S. Cl. ..... 5/81.1 R; 5/85.1; 5/86.1; 5/87.1; 212/264; 248/346.07

[58] Field of Search ..... 5/81.1 R, 83.1, 5/85.1, 86.1, 87.1, 84.1; 212/264; 248/424, 346.07

[56] References Cited

U.S. PATENT DOCUMENTS

| | | | |
|---|---|---|---|
| 3,203,009 | 8/1965 | Lundberg | 5/87.1 |
| 4,057,240 | 11/1977 | Damico et al. | 5/611 |
| 5,077,844 | 1/1992 | Twitchell et al. | 5/87.1 |
| 5,365,621 | 11/1994 | Blain | 5/83.1 X |
| 5,544,375 | 8/1996 | Urness et al. | 5/611 |
| 5,560,054 | 10/1996 | Simon | 5/83.1 X |
| 5,586,740 | 12/1996 | Borlinghaus et al. | 248/424 X |
| 5,685,035 | 11/1997 | Urness et al. | 5/611 |
| 5,735,500 | 4/1998 | Borlinghaus et al. | 248/424 X |

FOREIGN PATENT DOCUMENTS

| | | | |
|---|---|---|---|
| 0241096 | 10/1987 | European Pat. Off. | 5/87.1 |

*Primary Examiner*—Brian K. Green
*Assistant Examiner*—Rodrigo J. Morales
*Attorney, Agent, or Firm*—McHale & Slavin PA

[57] ABSTRACT

A portable lifting apparatus for lifting and transferring of patients for use in combination with a sling or the like support. Separate motors are provided for control of up and down movement of the lifting arm, clockwise and counter-clockwise rotation of the column, extension and retraction of each of the legs individually and divergence and convergence of both legs simultaneously.

11 Claims, 4 Drawing Sheets

STORABLE PATIENT LIFT AND TRANSFER APPARATUS

BACKGROUND OF THE INVENTION

1. Field of the Invention

This invention relates generally to hoisting equipment and more particularly, to a portable lifting apparatus for lifting and transferring non-ambulatory persons.

2. Background Information

It is well known that persons confined to a bed due to illness, age, and so forth possess such limited mobility that movement or transfer is extremely difficult. Improper transfer can result in serious complications to the individual. For instance, the need to move a patient immediately after an operation is necessary yet a dangerous proposition as any movement of the body may undo the surgeon's most careful work. Just as important is the need to transfer a bed ridden person for bathing or exercise so as to facilitate recovery.

In a hospital setting, a transfer is typically performed by a number of hospital workers in order to comfortably lift a patient from one position to another. If the transfer is made only by hand, the hospital personnel risk injury to their backs. If the transfer utilizes too few personnel or requires reaching in an awkward position, the personnel may strain their own bodies. Despite the number of personnel employed to assist in the transfer, the patient is simply susceptible to injury from anyone who touches or lifts incorrectly.

For these reasons, a number of devices are presently available for lifting and lowering of incapacitated persons from a bed, chair, bath or the like position. U.S. Pat. No. 5,185,895, issued to Gagne, sets forth a patient lift device consisting of a base frame having vertically oriented guideposts wherein a carriage assembly moves along the guideposts in response to an operator applied control signal. An arm assembly projects over the person who is placed into a sling for lifting. The patent discloses a basic lift and transferring apparatus of the prior art. The problem with such a device is the size necessary in order to accomplish the intended service. In particular, the prior art device employs elongated legs and a boom which is necessary to lift a patient. This prevents the device from being easily transferred or stored. The length of the components are necessary so that the apparatus can fit beneath a bed or chair yet provide sufficient support during the lifting process.

Thus a primary problem with the instant apparatus, as well as the remainder of the known prior art, is that the support and lifting structure must be sized adequately in order to support the lifting of the patient. However, the structure interferes with transportation and storage of the device. Since all components in the prior art remain in an extended position, they may cause a person to trip or run into the device. Such a device is difficult to transport and store for the legs and boom remain in an outward position.

U.S. Pat. No. 5,084,921 is another example of a patient lift and transfer apparatus having a unitary frame which consists of a caster wheel equipped U-shaped horizontal disposed frame. The invention discloses a unique vertically disposed pivotally biased arm to lift a patient supporting sling for moving a patient. Again the legs of this apparatus are capable of being placed beneath a patient's bed providing sufficient support for the lifting apparatus as well as the patient. However, no provision is made for storage or transportation of the apparatus.

U.S. Pat. No. 4,712,257 is still another patient lift device consisting of a lifting arm and sling hanger supported by a rigid frame having a U-shaped base structure using wheels for ease of frame movement. The invention further discloses the use of a sling having spaced apart attachment points for use in combination with a vertical bearing to prevent swinging movement of a patient placed within the sling.

U.S. Pat. No. 5,077,844 sets forth an apparatus for lifting and moving patients wherein the frame is permanently attached to a fixed structure. This apparatus eliminates the need for legs but limits the use to non-portable placement.

U.S. Pat. No. 4,484,366 sets forth a patient transfer device which again relies upon the use of a fixed base which fits beneath the patient's chair or bed making the unit impractical to store in a compact position.

U.S. Pat. No. 5,185,895 discloses an apparatus for lifting patients and transporting them. The apparatus is based upon electrical motors to provide assistance in patient movement wherein the arm members can telescope and then retract. This apparatus does not teach the retraction of the arms for purposes of storage or transportation.

Thus, there is a need for a lifting and transferring apparatus which is simple to operate, provides enhanced stability during use and retracts into a compact position to permit ease of storage and transportation of the apparatus.

The present invention satisfies this need through provision of a lifting apparatus having leg support structures in the form of telescoping leg assemblies capable of extension and divergence. The apparatus meets the particular problems commonly found in hospitals and convalescent homes where short term lifting capabilities are necessary. Unique to this invention is the ability to lift up to six hundred pounds yet retract in size for purposes of transporting and storage. In operation the support legs provide about a seventy eight inch stance when fully extended. In a retracted position, the support legs telescope together leaving a frame footprint of approximately fifty two inches. The invention consists of a miniature crane comprising a rotatable column with a lifting arm that can be raised and lowered at the upper end. The column is rotatably coupled to the portable base frame and is operably attached to an electric motor driven linear actuator that enables independent and reversible rotation of the column to facilitate placement of the end of the lifting arm above the patient's bed and permit transport away from the bed, for example to a chair or wheelchair. An additional electric motor driven linear actuator makes raising and lowering of the lifting arm effortless.

The support legs may be further extended outwardly from the frame once the apparatus is positioned at the bedside. This feature allows for ease of movement to various sights, but allows for greater stability during use. Additionally, the support legs, which are normally parallel with respect to each other, are pivotally attached to the base frame and operatively associated with an additional electrically driven linear actuator. Operation of this actuator enables simultaneous angular displacement of the leg assemblies so as to cause divergence or convergence thereof. This feature provides a safe and efficient means by which the stability of the entire apparatus may be enhanced during the lifting procedure. Additionally, since the extension and divergence of the support legs is carried out beneath the bed, access to the bed and the patient is not hampered in any way.

Once the apparatus is in position the unit can be easily secured by locking the frame mounted wheels. In a preferred embodiment the apparatus uses four wheels, two of which are lockable caster wheels similar to those found on stretchers, positioned at the rear of the support base. Two additional casters are affixed to the lower portion of the support legs at their outermost or distal end.

With the support legs in an extended and divergent position, an operator can maneuver the lifting arm over a patient's bed wherein a hook is available for attaching to a patient sling. The sling is placed beneath the patient so as to facilitate support during transfer. The combination of actuator and lifting arm is capable of lifting up to six hundred pounds through an angular range of motion of about 50–90 degrees along the vertical axis. The column is further able to rotate about its axis on the order of about 30–70 degrees from a starting position, e.g. perpendicular to the rear edge of the support base, in either a clockwise or counterclockwise direction. Angular rotation of the column is performed by use of an electric motor coupled to a linear actuator.

Thus, an objective of the instant invention is to provide a patient lift device or apparatus that is simple to operate and employs retractable components so as to facilitate storage and transport thereof.

Yet another objective of the instant invention is to provide a device that can be operated by a single person and is easily moveable in confined areas such as those found in a hospital or convalescent home.

Still another objective of the instant invention is to teach a device with divergent and extensible support legs to provide enhanced stability during use.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
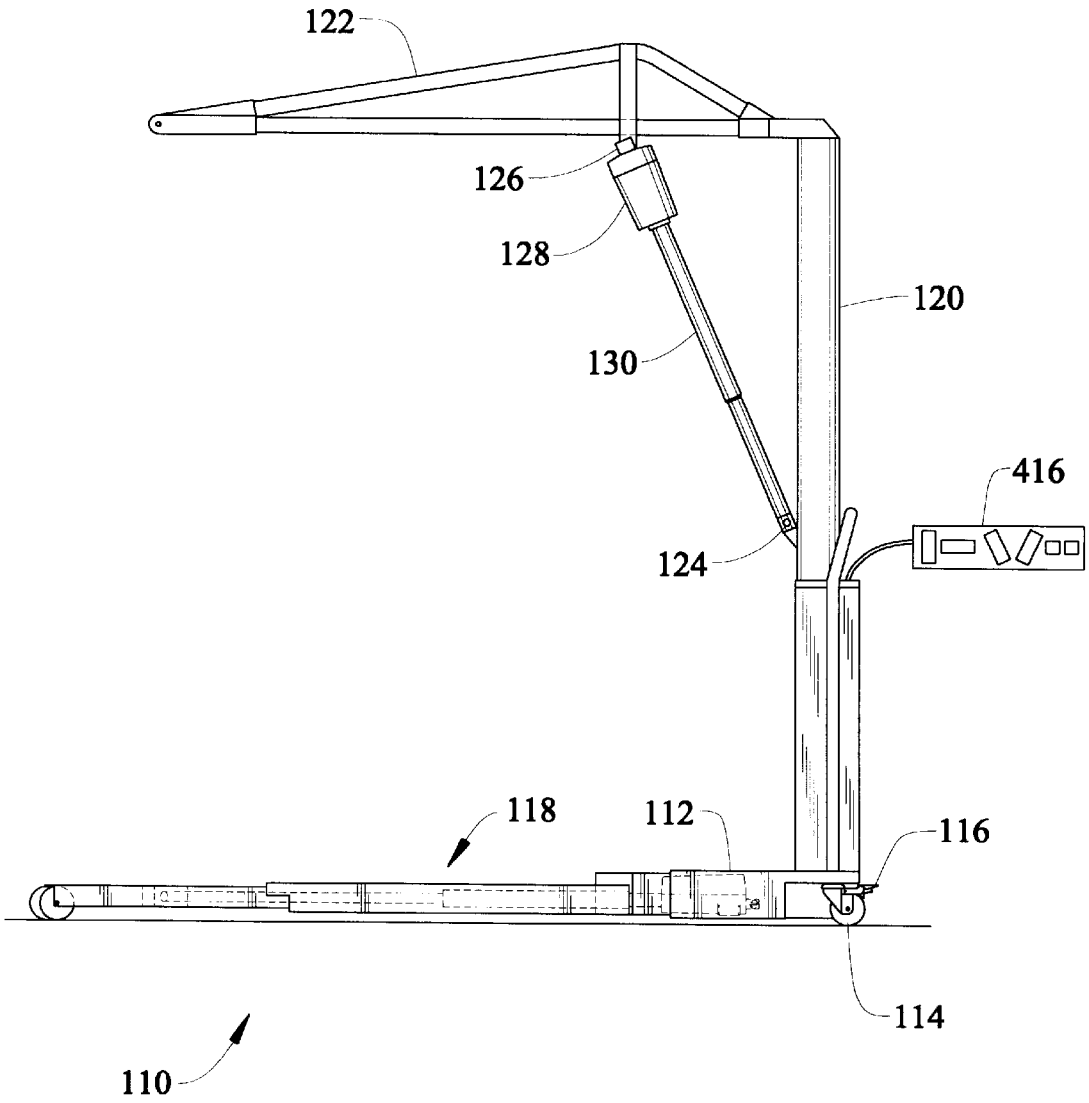
FIG. 1 is a side view of the instant invention with the support legs extended and the lift arm in a horizontal position.

Referring now to FIG. 1, shown is the preferred embodiment of the instant invention 110 comprising a support base 112 having two locking rotatable casters 114 secured to the bottom of said base 112. Foot operated levers 116 provide simplified engagement of the wheel locks. Rotable column 120 extends vertically from and is mechanically linked to support base 112 via column mount 314 (see FIG. 3). Lift arm assembly 122, shown in a horizontal orientation, is pivotally attached to column 120 at first pivot point 124 and second pivot point 126. Extension of the lift arm from about 29 degrees above to about 45 degrees below the horizontal reference position shown is accomplished by electric motor driven linear actuator 128. The actuator 128 acts a lifting means, providing power to extend or retract actuator rod 130 thereby raising or lowering lift arm assembly 122 actuator rod 130.

Figure 2:
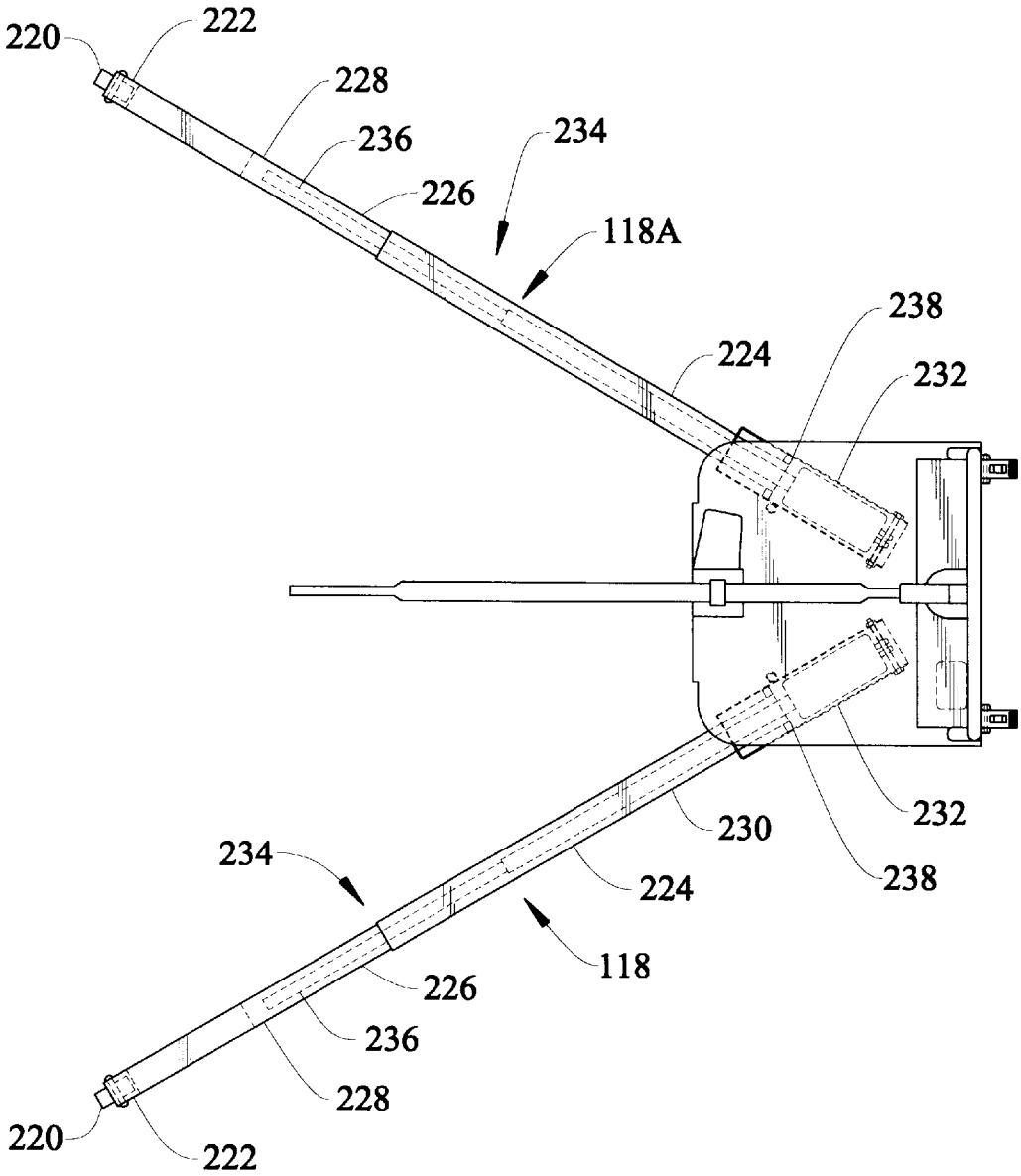
FIG. 2 is a top view of the instant invention with the support legs extended and diverged.

Referring now to FIG. 2, pivotally mounted to the support base 112 are extensible legs 118 and 118A having a rotatable caster 220 mounted at a distal end 222 thereof. Each of the legs 118 and 118A are formed of a leg weldment 224 and a leg extension 226, which together define a telescoping leg assembly 234 capable of reversible extension from the support base. The leg extension 226 is in nesting relation with the leg weldment 224 and includes a leg cylinder bracket 228 which is operatively associated with the distal end portion 236 of telescoping actuator rod 230. The proximal end 238 of said telescoping actuator rod is operatively associated with a linear actuator 232 for reversible extension of said leg assembly 234.

Figure 3:
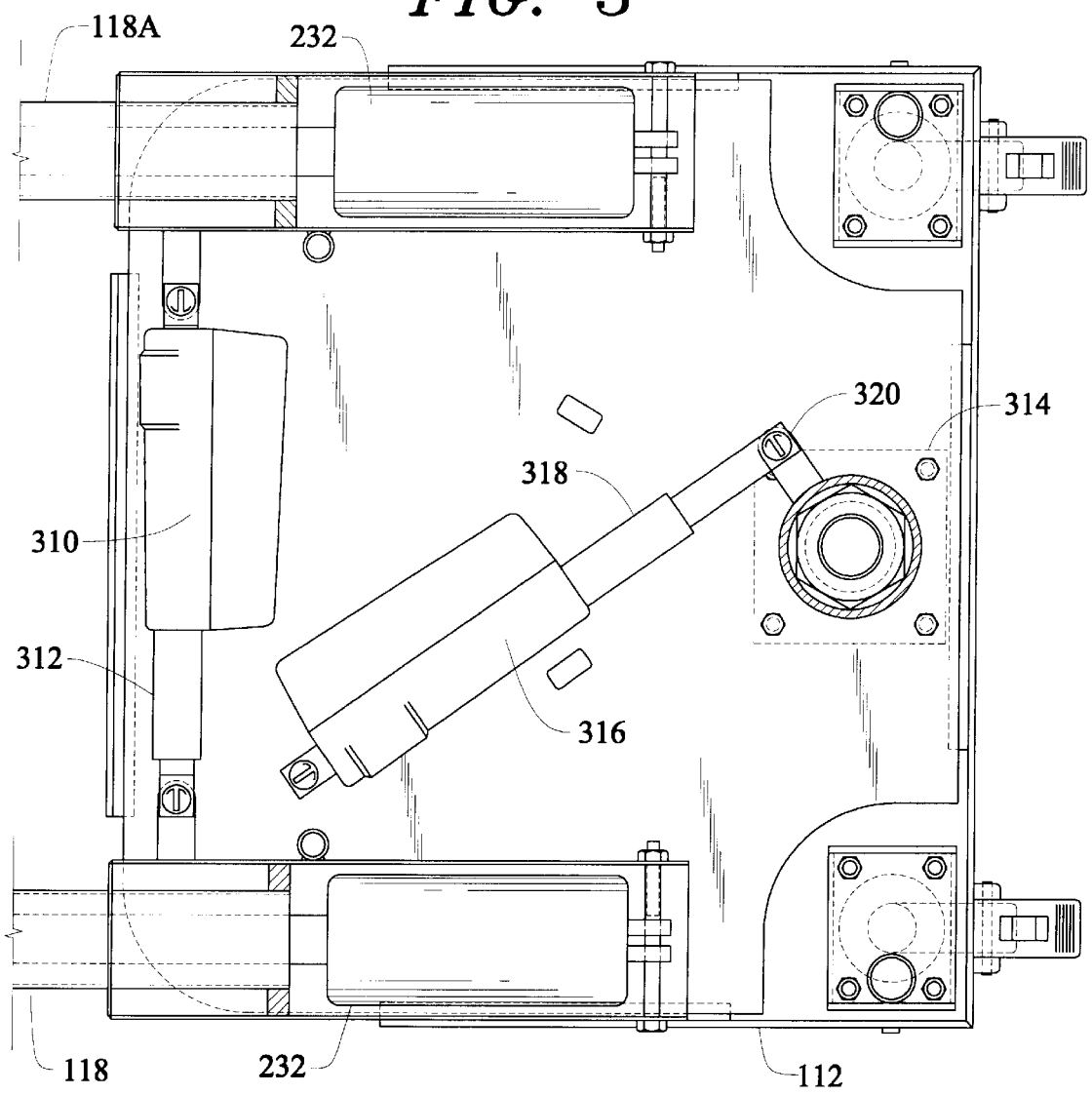
FIG. 3 is a cross-sectional top view of the support base.

Referring now to FIG. 3, a top cross-sectional view of support base 112 shows actuator motors 232 which each operate independently for extension of legs 118 and 118*a* as desired. An additional motor 310 is mechanically linked to each of legs 118 and 118A. Activation of motor 310 causes actuator rod 312 to pivot the legs outwardly from their initial parallel orientation to a point where they circumscribe about a 40° to a 90° angle. The operator is thus able to reversibly extend each of legs 118, 118A independently, while simultaneously causing said legs to reversibly diverge from one another. This allows the device to be easily transported from one patient area to another when in its compact retracted configuration. Once in position at the patient's bedside, the legs may then be extended and diverged so as to define a longer and wider footprint thereby providing enhanced stability during the patient lifting process. Column mount 314 retains the column in a vertical orientation with respect to the support base 112 while allowing the column to rotate about its axis. Electrically driven linear actuator 316 acts as a column 120 rotation means that reversibly extends an actuator rod 318 which is pivotally attached to column 120 via an attachment arm 320. The column has a total angular sweep of about 30° to about 70° to either side of a reference position wherein it is perpendicular to a plane defined by the handle 410 (see FIG. 4).

In operation, it is recommended that a patient be placed upon a support sling, subsequent to which the lift arm is positioned above the patient and a lifting bar is properly positioned over the support sling. This configuration minimizes any swinging tendency as the support sling and patient is pulled upward. A hook for attachment to the support sling may be attached to the end of the lift arm assembly 122. While positioning the device it may be left free to roll so as to more easily align the end of the lift arm assembly above the patient. Once the device is properly located, the locking casters are engaged so as to prevent any undesirable movement during the lifting process.

Figure 4:
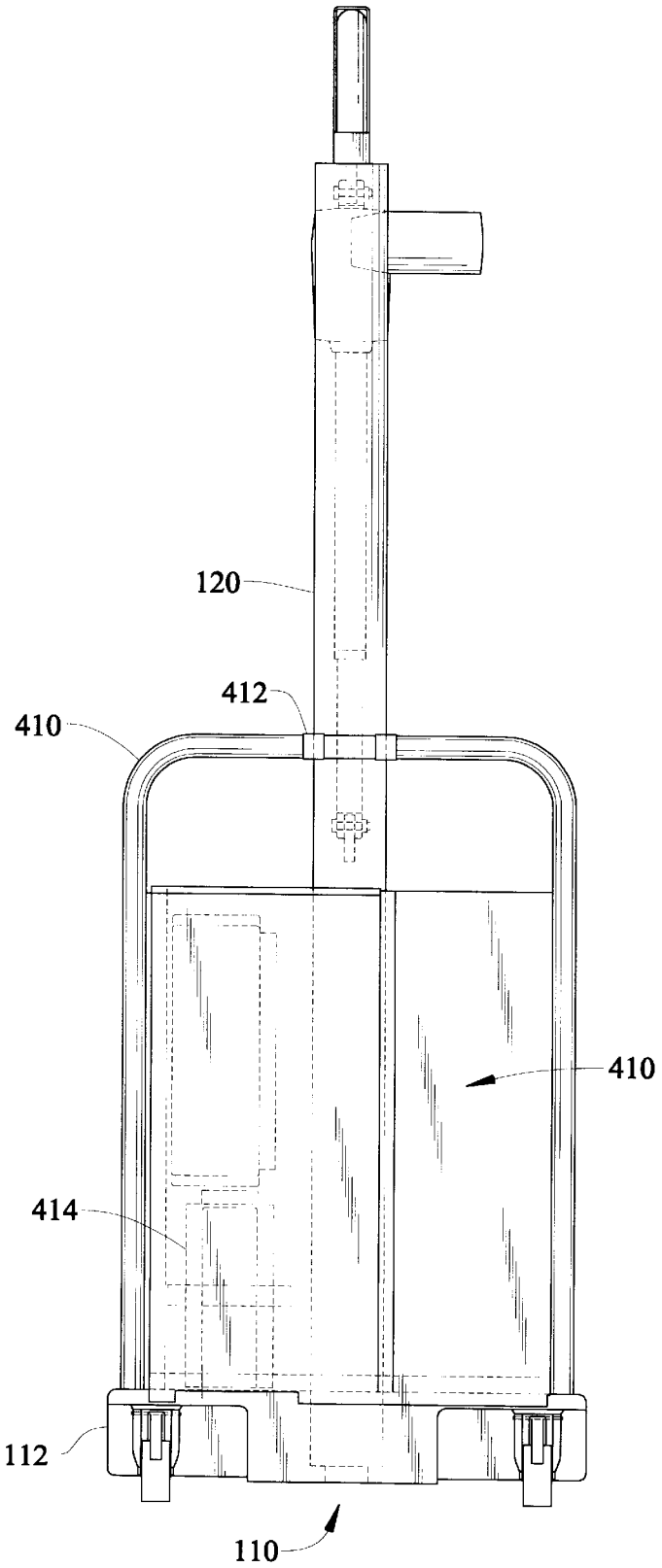
FIG. 4 is a back view of the device.

Referring now to FIG. 4, a back view of the device 110 shows U-shaped handle 410 which is attached to support base 112 and further to column 120 via a handle strap 412. The handle encloses a basket area 410 which contains a controller 412 for transmitting signals to the various actuator motors and a battery 414 for powering the various electrically controlled device. A remote controller (not shown) is provided in electrical communication with the control panel. The remote controller contains the necessary switching devices to control up and down movement of the lifting arm, clockwise and counterclockwise rotation of the column, extension and retraction of each of the legs individually and divergence and convergence of both legs simultaneously.

What I claim is:

1. An apparatus for lifting and transporting patients comprising:

a base frame;

a plurality of wheels affixed to a lower portion of said base frame providing portability of said frame;

first and second spaced apart telescoping leg assemblies having a proximal end and a distal end, said proximal end pivotally coupled to said lower portion of said base frame, each said telescoping leg assembly being adjustable between a first retracted position and a second extended position;

rotatable casters affixed to a lower portion of the distal end of each of said first and second telescoping leg assemblies;

means for independently and reversibly extending each said telescoping leg assembly from said first retracted position to said second extended position;

means for reversibly diverging said telescoping leg assemblies from a first essentially parallel position to a second divergent position;

a column having a proximal end and a distal end, said proximal end being rotatably coupled to said base frame;

column rotation means for reversibly rotating said column about said column vertical axis;

a lifting arm pivotally attached at one end thereof to said column distal end; and lifting means operatively associated with said lifting arm and said proximal end of said column for raising and lowering of a patient.

2. The apparatus according to claim 1 wherein:

said means for reversibly extending each said telescoping leg assembly is an electric motor mechanically linked to each said telescoping leg assembly so as to cause each said telescoping leg assembly to independently extend or retract during operation thereof.

3. The apparatus according to claim 1 wherein:

said means for reversibly diverging said telescoping leg assemblies is an electric motor mechanically linked to said assemblies wherein operation of said motor causes angular displacement of said telescoping leg assemblies.

4. The apparatus according to claim 1 wherein:

said column rotation means is an electric motor mechanically linked to said column whereby operation of said motor causes axial rotation of said column.

5. The apparatus according to claim 1 wherein:

said lifting means is an electric motor mechanically linked between said column and said lifting arm wherein operation of said motor causes said arm to raise or lower.

6. The apparatus according to claim 1 wherein said column is rotatable through an arc having a magnitude of approximately forty degrees.

7. The apparatus according to claim 1 wherein said wheels can be locked.

8. The apparatus according to claim 1 wherein said lifting arm pivots about a substantially-horizontal axis through an arc having a magnitude of approximately forty degrees.

9. The apparatus according to claim 1 further including a control means for the transmission of signals to the extension, diverging, rotating and lifting means.

10. The apparatus according to claim 9 wherein said control means is defined as a remote control unit in electrical communication with said control means, wherein said remote control unit contains the switching means to control up and down movement of the lifting arm, clockwise and counter-clockwise rotation of the column, extension and retraction of each of the telescoping leg assemblies individually and divergence and convergence of both telescoping leg assemblies simultaneously.

11. The apparatus according to claim 1 wherein in said second divergent position, said telescoping leg assemblies circumscribe an arc having a magnitude of about fifty degrees.

* * * * *